United States Patent [19]

Bryant

[11] Patent Number: 4,575,333

[45] Date of Patent: Mar. 11, 1986

[54] FLAME MONITOR TIME DELAY CONTROL

[76] Inventor: Jack A. Bryant, 500 Main St., Apt. 6, Melrose, Mass. 02176

[21] Appl. No.: 606,176

[22] Filed: May 2, 1984

[51] Int. Cl.[4] ..... F23N 5/20

[52] U.S. Cl. ..... 431/18; 431/69; 431/75

[58] Field of Search ..... 431/6, 15, 18, 69, 75, 431/24, 25, 73, 74; 307/117, 130; 340/577, 578, 579

[56] References Cited

U.S. PATENT DOCUMENTS 4,319,873 3/1982 Michaud et al. ..... 431/24

FOREIGN PATENT DOCUMENTS 0159740 12/1979 Japan ..... 431/69

0077624 6/1981 Japan ..... 431/75

0016721 1/1982 Japan ..... 431/75

2078855 1/1982 United Kingdom ..... 431/18

2079927 1/1982 United Kingdom ..... 431/75

2089975 6/1982 United Kingdom ..... 431/25

*Primary Examiner*—Margaret A. Focarino

*Attorney, Agent, or Firm*—Russell & Tucker

[57] ABSTRACT

Apparatus for monitoring flames is provided with means for sampling both the value of a flame and the period of time during which a flame remains above a given intensity level during start-up. Flame-off delay means is also provided in combination with means for delaying a flame-on indication, means for segregating the respective operations thereof, and means for maintaining the durations of the flame-on and flame-off delays in fixed proportional relationship.

12 Claims, 3 Drawing Figures

FLAME MONITOR TIME DELAY CONTROL

Field of the Invention

This invention relates to flame monitoring, and more particularly, to equipment for the indication of flame-on and flame-off conditions together with control means responsive to the quality and duration of the flame. Still more particularly, the invention relates to monitoring the quality and duration of a flame during start-up.

BACKGROUND OF THE INVENTION

Flame monitors currently in use are provided with several methods of assuring continued burner operation despite fluctuations in flame intensity. One method is to provide a time delay after the flame intensity had dropped below a given threshold before de-energizing the flame relay. Then, if the cause of the drop were only a momentary fluctuation of the flame due to smoke or other cause, while the flame is still actually functioning properly, the system will not be shut down. Another method is to establish a given threshold of flame intensity to be reached before indicating a flame-on condition and arranging it so that, thereafter, the flame-on condition will continue to be indicated as long as the intensity of the flame does not fall below a given lower level (referred to as a "hysteresis" type of operation). In this way, a measure of control is provided during start-up by assuring that a flame-on condition will not be indicated until the fluctuations exceed the given high threshold.

Such methods are reasonably adequate for gas and oil flames in which the fluctuations during normal operations are relatively minor. They are not adequate, however, for low caloric fuels, such as pulverized coal and waste fuels used in the process industries, particularly during start-up operations in which the intensity of the flame may fluctuate radically giving an indication of a flame-on condition at a time when the fire box may not be hot enough for burner operation without igniter assistance. What is needed is to prevent the indication of a flame-on condition until the flame intensity has remained at a given value for a preselected period of time. This need for detection of flame intensity duration arises also, for example, when starting up an oil burner in an already operating waste fuel furnace at a time of change-back from waste fuel to fuel oil. The monitor of the oil burner must be arranged so as to avoid falsely indicating a flame-on condition in response to the high intensity, momentary flares from the waste fuel flames in the background. Here again, an extended duration indication of a given flame-on signal level containing for a substantial period is needed to prevent these momentary flares from the waste fuel flame from falsely indicating a flame-on condition for the oil flame.

Accordingly, a primary object of the invention is to provide means in a flame monitoring for sampling a flame and limiting the indication of a flame-on condition on start-up to situations in which the flame intensity has exceeded a given value for a preselected duration. A further object is to provide such a monitor together with means for delaying the indication of a flame-off condition following the detection of normal flame-on conditions. Still another object is to provide means for maintaining the respective durations of delay of the respective flame-on and flame-off indications in a proportionally fixed relationship.

SUMMARY OF THE INVENTION

In the accomplishment of these and other objects of the invention, in a preferred embodiment, a flame detector is employed to energize a flame relay. A delay means is interposed between the detector and the relay to delay the energization of the relay until the detector has continuously judicated a flame intensity above a given value for a preselected duration. A further means is provided for delaying the de-energization of the relay, once the relay has become energized, for a second preselected duration. Additional means are provided for holding the two preselected durations in fixed proportional relationship.

BRIEF DESCRIPTION OF THE DRAWINGS

The preferred embodiments of the invention is illustrated in the accompanying drawings in which.

DESCRIPTION OF PREFERRED EMBODIMENT

Figure 1:
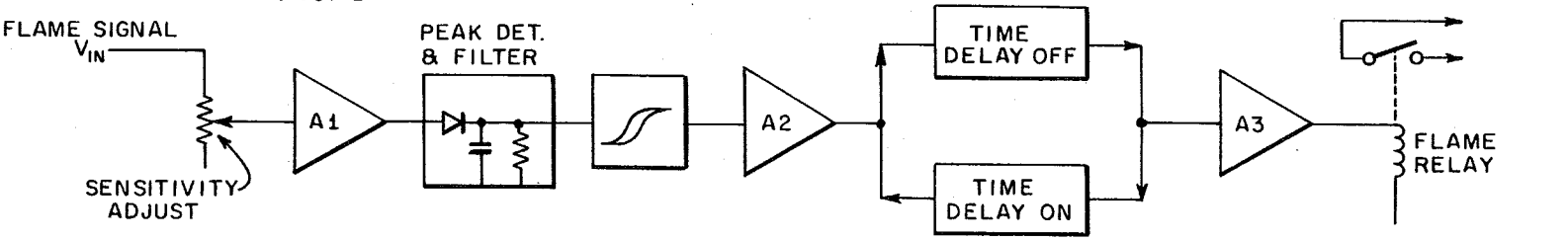
FIG. 1 is a functional block diagram.

FIG. 1 shows a block diagram of the circuit. The flame signal is first fed to a potentiometer which is the sensitivity adjustment for the circuit. The signal is then amplified (A1) and fed to a peak detector and filter. The following stage incorporates a fixed hysteresis such that a higher level signal is required to turn on A2 than to turn it off. A2 is a voltage comparator amplifier that responds to a certain input threshold by its output switching digitally on or off.

When A2 is switched on (flame signal present) its output feeds a time delay ON circuit which, after a time delay, energizes flame relay driver A3. When A2 switches off (flame signal no longer present) the time delay OFF circuit if activated which, after a time delay, de-energizes flame relay driver A3.

Figure 2:
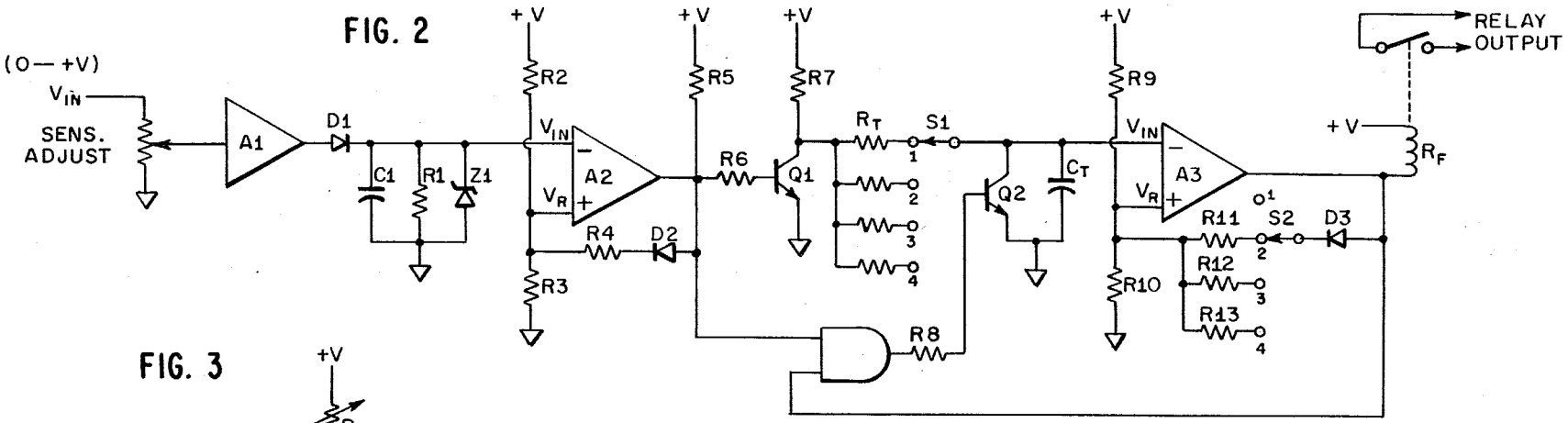
FIG. 2 is a schematic diagram.

FIG. 2 shows a more detailed schematic of the circuit. S1 controls the time delay OFF time and S2 controls the time delay ON time. Shown are 4 switches time delay OFF times and 4 switchable time delay ON times. In this scheme, the time delay ON time setting is a ratio of the time delay OFF time. More specifically, when S2 is in position 1 there is no time delay ON, that is, when amplifier A2 switches ON, almost immediately relay driver A3 energizes the flame relay (output). When S2 is in position 2 the time delay ON time will be $\frac{1}{4}$ the time delay OFF time and in position 3 and 4 the time delay ON time will be $\frac{1}{3}$ and $\frac{1}{2}$ respectively, of the time delay OFF time.

It was found from experience that this relative arrangement of time delay ON versus time delay OFF was more practical than having independent time delays ON and OFF. The reason being that when a marginal flame situation was encountered the perturbations and irregularities of flame affected both the flame ON and flame OFF requirements such that a longer flame OUT time requirement usually required a longer flame ON time. This ratio approach also will help prevent a bad selection of time delay ON. For Example, if one sets the time delay OFF according to the local standards for the fuel being burned it is impossible to create a dangerous or invalid condition by the time delay ON selection.

DETAILED DESCRIPTION

Refer to FIG. 2 for this description. The flame signal at input (0 to $+V$) is fed to sensitivity adjustment potentiometer. This adjustment establishes the threshold of flame detected (or not detected). The output of potentiometer is amplified by A1 and fed to a signal diode D1 which acts as a peak detector to the fluctuating flame signal. (The reason for doing this will be explained later.) This peak signal is filtered by the RC components R1, C1 and is also clamped by zener diode Z1. This clamping action prevents the signal from getting out of the control range established by the thresholds of A2 and keeps the time delay OFF of this stage to a minimum.

A2 is a voltage comparator amplifier which switches state when the input signal $V_{IN}$ crosses the reference input $V_R$. With no signal present at $V_{IN}$, the output of A2 is high. A2 employs an open collector output so effectively the output transistor of A2 is off causing the output of A2 to go high by virtue of load resistor R5. This results in transistor Q1 turning on (Q1 in saturation) by current flowing through base resistor R6. Current also flows through D2, R4 and R3 causing $V_R$ of A2 to be at a more positive voltage.

A2 changes state (output goes low) when the input signal $V_{IN}$ reaches the reference input $V_R$. This in turn reverse biases D2 causing $V_R$ to be at a lower voltage established by voltage divider R2 and R3. This action is the voltage hysteresis mentioned before and shown in block diagram (FIG. 1).

With flame signal present and the output of A2 low (almost ground potential) transistor Q1 is turned off. This causes timing capacitor $C_T$ to charge through timing resistor $R_T$ and R7. The collector resistor R7 of Q1 is more than 10 times smaller in value than $R_T$ which results in a charge time dictated primarily by $R_T$ and $C_T$.

A3 is also a voltage comparator amplifier and operates the same way as A2. With no charge (voltage) on $C_T$, the output of A2 is high, that is, its output transistor is off causing its output to go high by virtue of the $R_F$ relay coil. Current flows through $R_F$ coil, D3, R11 and R10 causing $V_R$ of A3 to be at a more positive voltage.

A3 changes state (output goes low) when the charge on $C_T$ reaches the reference input $V_R$. This energizes the output relay $R_F$ and reverse biases D3 causing $V_R$ to be at a lower voltage established by R9 and R10. This action is the same type voltage hysteresis as used with A2 except that there is a much wider spread in the $V_R$ voltages associated with A3. Also note that S2 is used to select different reference voltages (when A3 is off) via R11, R12 or R13.

Note that the first position of S2 does not have a resistor in the circuit feeding back to the reference voltage input $V_R$ of A3 and is effectively an open circuit. $V_R$ is established solely by the voltage divider resistors R9 and R10. $V_R$ is at its lowest voltage so as timing capacitor $C_T$ charges the threshold of A3 is quickly reached, that is, the input of A3 quickly crosses the referencee voltage $V_R$ causing A3 to change state which energizes the output relay $R_F$. This first position of S2 is the "instant on" position, that is, no time delay ON.

The time delay ON is established by the charge time of $R_T$ and $C_T$. When the voltage of $C_T$ reaches the reference voltage $V_R$ the output relay is energized. S2 selects $V_R$. Note that in position 1 $V_R$ is the same with flame OFF as with flame ON. In position 2, R11 is switched in—its value chosen to create a more positive $V_R$. In position 3, R12 is switched in causing a more positive $V_R$ still and in position 4, R13 causes $V_R$ to go more positive again. These progressive more positive $V_R$ steps have been chosen to create the $\frac{1}{4}$, $\frac{1}{3}$ and $\frac{1}{2}$ ratios of flame OUT times mentioned before.

Time delay OFF is established solely by $R_T$ and $C_T$. With flame signal present the charge on $C_T$ reaches +V (power supply). Note that transistor Q2 is off by virtue of AND gate output being low (practically at ground potential). The reason for this AND gate and Q2 will be explained shortly. A flame out condition will cause A2 to turn off resulting in its output going high which causes Q1 to turn on. This drops the junction of R7 and $R_T$ to ground potential causing $C_T$ to discharge through $R_T$. When the voltage on $C_T$ reaches $V_R$ (the lowest voltage established by R9 and R10) A3 switches off de-energizing the output relay $R_F$.

The reason for the AND gate whose inputs are fed by the outputs of A2 and A3, is to control the discharging transistor Q2. The action of Q2 is to discharge $C_T$ immediately rather than gradually through $R_T$. This rapid discharge only occurs when there is a no flame detected condition, that is, when A2 is off and its output is high *and* when A3 is off and its output is high. This AND relationship assures there must be a continuous stable flame present for the entire period of the time delay ON.

For example, suppose the time delay OFF has been selected by S1 for 4 seconds and the time delay ON has been selected by S2 for the ratio $\frac{1}{2}$ (time delay OFF). This switches in R13 selecting a reference voltage $V_R$ of A3 that will cause a time delay ON for 2 seconds. This means that the charge on $C_T$ must reach the selected $V_R$ before the output will be energized. If the flame signal is steady and continuous this will occur in 2 seconds. If the flame signal is spurious or discontinuous the output of A2 will switch back and forth causing Q2 to discharge $C_T$ each time the flame signal drops out.

This function, which effectively is monitoring the "quality" of flame on startup, is one of the primary attributes of this invention. In most burner control systems it is important to know on startup that the flame detected is stable. This attribute in a flame monitor in conjunction with the time trial for flame in the burner control system provides maximum safety on startup, particularly for the first burner to be started in a multiburner furnace.

It will be noted that the flame signal input feeding the sensitivity potentiometer is a unipolar signal, that is, a signal that varies between ground and some positive voltage. The potentiometer and amplifier A1 shown in FIG. 1 and FIG. 2 assumes this to be an analog flame signal.

Figure 3:
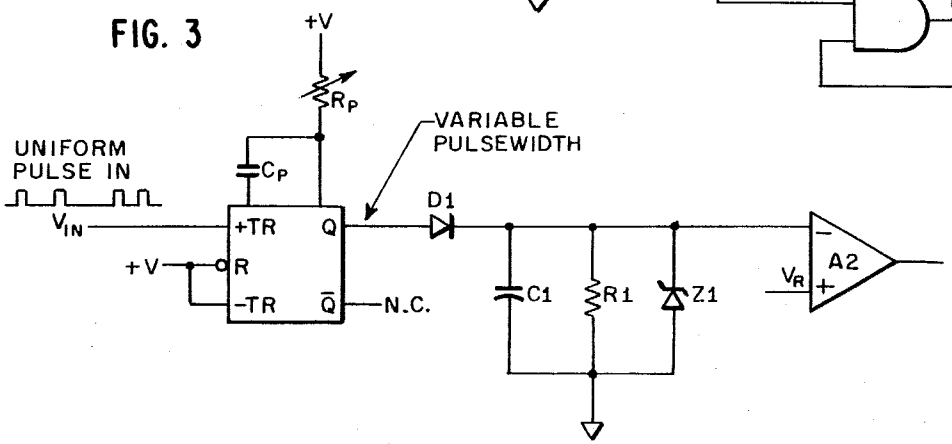
FIG. 3 is a schematic diagram of an alternative form.

FIG. 3 shows a circuit that will accommodate a pulsing flame signal. This is important for those flame monitors that have outputs that are inherently pulsing. For example, an ultraviolet (UV) flame monitor produces pulses when flame is present, the number of pulses per time proportional to the UV radiation present. (The UV radiation produced by the combustion process.) In this circuit (FIG. 3) the pulses are fed to a monostable multivibrator (oneshot circuit) with variable pulse width. Variable resistor Rp is the sensitivity adjustment control. The output of this monostable is fed to peak detector D1. Hence the reason for peak detector and filter in the first stage.

It will b understood that given the foregoing description, certain variations will become apparent to those skilled in the art. For example, a signal derived from the energization of A3 may be employed for purposes other than (or in addition to) driving a flame relay. Thus, it can be used to control an automatic flame intensity sampler whereby the flame can be sampled provisionally with the ignitor off for a given delay period and if the flame is insufficient, to reactivate the ignitor, or if the flame is sufficient during the provisional period, to sample it again before final approval. Such variations are available within the burner management system.

Another variant is to employ means associated with the sensitivity adjustment for providing two intensity levels for flame detection, one for start-up including the influence of the igniter, and a second intensity level for only the flame by itself. With such an arrangement, the flame relay will not be energized until the combined intensity flame is reached for the given period. Thereafter, the system can be set to respond to a different intensity level corresponding to the flame alone without the igniter.

Since various modifications can be made, the intention is not to confine the invention to the precise form herein shown, but rather to limit solely accordingly to the appended claims.

I claim:

1. Apparatus for monitoring a flame comprising in combination:

(a) means for detecting the intensity level of a flame;
(b) means for controlling said flame;
(c) flame-on timing means arranged to time out after a predetermined period;
(d) means for starting said flame-on timing means and continuing its operation only while the intensity level of said detecting means remains above a preselected value; and
(e) means for actuating said control means when said flame-on timing means times out.

2. The apparatus defined in claim 1 further characterized by:

(f) flame-off timing means arranged to time out after a predetermined period;
(g) means for starting said flame-off timing means and continuing its operation only after said control means has been actuated by said actuating means and only while the intensity level of said detecting means remains below a preselected value; and
(g) means for deactivating said control means when said flame-off timing means times out.

3. The apparatus defined in claim 2 further characterized by:

(i) means for varying the predetermined periods of said flame-on timing means and said flame-off means.

4. The apparatus defined in claim 3 further characterized by:

(j) means for maintaining the predetermined periods of said flame-on timing means and said flame-off timing means in fixed proportional relationship.

5. The apparatus defined in claim 2 further characterized by:

(k) the predetermined period of said flame-on timing means being a fixed fraction of the period of said flame-off timing means.

6. The apparatus defined in claim 2 further characterized by:

(l) the predetermined period of said flame-on timing means being one-half that of said flame-off timing means, or less.

7. The apparatus defined in claim 2 further characterized by:

(m) the preselected value of said means for starting said flame-on timing means being higher than that of said means for starting said flame-off timing means.

8. Apparatus for monitoring a flame comprising in combination:

(a) means for detecting the intensity level of a flame and providing a voltage signal proportional thereto;
(b) means for controlling a flame;
(c) flame-on timing means arranged to time out after a flame-on predetermined period;
(d) voltage comparator means for starting said flame-on timing means only when the signal of said detecting means exceeds a start preselected voltage;
(e) hysteresis means associated with said voltage comparator means for maintaining the operation of said flame-on timing means only as long as the signal of said detecting means remains above a preselected flame-off voltage lower than said start voltage; and
(f) means for actuating said control means when said flame-on timing means times out.

9. The apparatus defined in claim 8 further characterized by:

(g) flame-off timing means arranged to time out after a flame-off predetermined period;
(h) means for starting said flame-off timing means when the level of said detecting means falls below a preselected flame-off voltage; and
(i) means for deactivating said control means only when said flame-off timing means times out without the voltage of said detecting means having risen above the flame-off voltage.

10. The apparatus defined in claim 9 further characterized by:

(j) means for interrupting the operation of said flame-on timing means, said voltage comparator means, said hysteresis means, and said actuating means during the operation of said flame-off timing means in response to said means for starting said flame-off timing means.

11. Apparatus for monitoring a flame comprising in combination:

(a) means for detecting the intensity level of a flame;
(b) means for controlling said flame having an actuated state and an inactive state;
(c) flame-on timing means arranged to time out after a predetermined flame-on delay period;
(d) means for starting said flame-on timing means only when said control means is in the inactive state, and for starting and continuing the operation of said flame-on timing means only when the intensity level of said detecting means exceeds and remains above a preselected value; and
(e) means for actuating said control means when said flame-on timing means times out.

12. The apparatus defined in claim 1 further characterized by:

(f) flame-off timing means arranged to time out when the average length of time during which the signal level of said detecting means remains below a preselected value for a predetermined flame-off delay period;
(g) means for starting said flame-off timing means only when the signal level of said detecting means drops below said preselected value and said control means is in the inactive state, and continuing the operation of said flame-off timing means until the average length of time during which the signal level of said detecting means remains below the preselected value for said predetermined flame-off delay period;
(h) means for deactivating said control means when said flame-off timing means times out.

* * * * *